US007140056B2

(12) United States Patent
Deering

(10) Patent No.: US 7,140,056 B2
(45) **Date of Patent: *Nov. 28, 2006**

(54) INFLATABLE PILLOW FOR A CHAIR OR TUB

(75) Inventor: William Deering, Litchfield, CT (US)

(73) Assignee: Deering Innovations, LLC, Litchfield, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/905,951

(22) Filed: Jan. 27, 2005

(65) Prior Publication Data

US 2005/0206208 A1 Sep. 22, 2005

Related U.S. Application Data

(60) Provisional application No. 60/547,233, filed on Feb. 24, 2004.

(51) Int. Cl.
*A47C 7/38* (2006.01)
*A47C 20/02* (2006.01)
*A47C 16/00* (2006.01)

(52) U.S. Cl. ..... 5/644; 5/640; 5/645; 5/655.3; 5/655.5

(58) Field of Classification Search ..... 5/644, 5/655.3, 655.5, 900, 910, 640, 645; 4/530, 4/575.1

See application file for complete search history.

(56) References Cited

U.S. PATENT DOCUMENTS 2,260,437 A * 10/1941 Chambers ..... 5/653
2,461,880 A * 2/1949 Curran ..... 4/575.1
2,582,439 A * 1/1952 Kavanagh ..... 297/396
3,050,748 A * 8/1962 Deutinger ..... 5/654
3,416,169 A * 12/1968 Emery ..... 5/644
3,909,859 A * 10/1975 Harris ..... 5/687
4,731,891 A * 3/1988 Scheurer et al. ..... 5/636
4,815,154 A 3/1989 Grimes
4,891,848 A * 1/1990 Carter ..... 4/571.1
5,014,373 A * 5/1991 Dobine ..... 5/636
5,020,168 A * 6/1991 Wood ..... 4/573.1
5,050,591 A * 9/1991 Sandrin ..... 601/168
5,140,713 A * 8/1992 Pesterfield ..... 4/575.1
5,255,955 A * 10/1993 Matosic ..... 297/395
5,317,772 A * 6/1994 Perl et al. ..... 5/644
5,806,110 A * 9/1998 Kunz et al. ..... 4/566.1
6,217,116 B1 4/2001 Sloot
6,357,061 B1 * 3/2002 Gonzalez ..... 4/580
6,684,429 B1 2/2004 Deering
6,760,933 B1 * 7/2004 Li ..... 4/578.1
2005/0172394 A1 * 8/2005 Ciechanowski et al. ..... 4/575.1

* cited by examiner

*Primary Examiner*—Michael Safavi
(74) *Attorney, Agent, or Firm*—McCormick, Paulding & Huber LLP

(57) ABSTRACT

An inflatable beach pillow with a pocket to slip over a beach chair and having both water and air compartments is furnished with suction for supporting the pillow from the side of a tub so that it will serve as a combination chair pillow and tub pillow. The suction cups are disposed either on the air compartment side or on the water compartment side.

5 Claims, 2 Drawing Sheets

INFLATABLE PILLOW FOR A CHAIR OR TUB

CROSS-REFERENCE TO RELATED APPLICATIONS

This application claims the priority of my now abandoned provisional patent application Ser. No. 60/547,233 filed Feb. 24, 2004.

BACKGROUND OF THE INVENTION

This invention relates to an inflatable pillow. More particularly, it relates to an inflatable pillow incorporating a water compartment that can either be used over the back of a chair, or can be used in a tub in the bath or at a spa.

An inflatable beach pillow having a pocket adapted to be filled with sand and having straps to attach it to a chair is shown in U.S. Pat. No. 4,815,154 issued Mar. 28, 1989 to Grimes. The Grimes patent uses sand as a weighting material and therefore would be of limited use in a swimming pool where there is no sand.

U.S. Pat. No. 6,217,116 issued Apr. 17, 2001 to Sloot discloses an inflexible pillow attached to a pocket-shaped slipcover designed to fit over the back of a chair, but having no means to use it as a weighted beach pillow.

My U.S. Pat. No. 6,684,429 issued Feb. 3, 2004 describes a beach pillow with an inflatable air compartment and a fillable water compartment on a flexible base sheet. The base sheet and sheet or sheets forming the compartments can be either permanently or temporarily connected on their sides to form a pocket. The pocket can be slipped over the back of the chair to allow the inflatable pillow to serve as a head rest. However, the pillow is not easily used in a tub or at the spa, because the walls of the tub are inclined and there is no means to hold it in place. If the pillow is used on a smooth surface, where there is high wind or on a moving object, such as the deck or bow of a boat, there is danger of it blowing away, even when the water compartment is used to add weight.

It would be desirable to extend the use of such an inflatable pillow so that it can serve as a headrest while using a tub in a bath or spa or on smooth surfaces in windy locations.

It would also be desirable to allow the user to adjust the cushioning effect of an inflatable pillow having both a water compartment and an air compartment when such a pillow is used in a tub or on the bow of a moving boat.

It would also be desirable to be able to adjust the temperature of the pillow by adding water of a desired temperature.

Accordingly, one object of the present invention is to provide an improved inflatable pillow that can be used either over the back of a chair or on smooth surfaces, such as a tub, or in a spa, or on the deck or bow of a boat.

Another object of the invention is to enhance the performance of an inflatable pillow especially adapted for use in a tub or at a spa by adding a water compartment for adjustable support and temperature control.

SUMMARY OF THE INVENTION

Briefly stated, the invention comprises an improvement to an inflatable pillow comprising a generally rectangular flexible base sheet arranged to be folded about a fold line extending between its side edges, a first flexible sheet section sealed about its periphery to the base sheet on one side of the fold line to define an inflatable air compartment, a second flexible sheet section sealed about its periphery to the base sheet on the other side of the fold line to provide a fillable water compartment, an air valve communicating with the air compartment for inflating and deflating it, a closure valve communicating with the water compartment for filling and draining it and connection means to permanently or temporarily connect the folded base sheet along the side edges to form a pocket that may be slipped over the back of a chair and used to retain the inflatable pillow on the chair back, said improvement comprising one or more suction cups attached to a said sheet section so that the inflatable pillow may optionally be attached to a smooth surface, so as to serve as a combination chair pillow and a pillow for an inclined or moving smooth surface. The suction cups may be attached either to the first sheet section or to the second sheet section.

DRAWING

Other objects and advantages of the invention will be better understood by reference to the following description, taken in connection with the accompanying drawings, in which:

FIG. 1 is a top plan view of the inflatable pillow, looking at the air compartment side, FIG. 2 is a bottom plan view of the inflatable pillow, looking at the water compartment side, FIG. 3 is a side elevation view, taken in cross section, showing the inflatable pillow being held on the back of a chair, FIG. 4 is a side elevation view, also in cross section, showing the inflatable pillow attached to the wall of a tub.

DESCRIPTION OF THE PREFERRED EMBODIMENT

Figure 1:
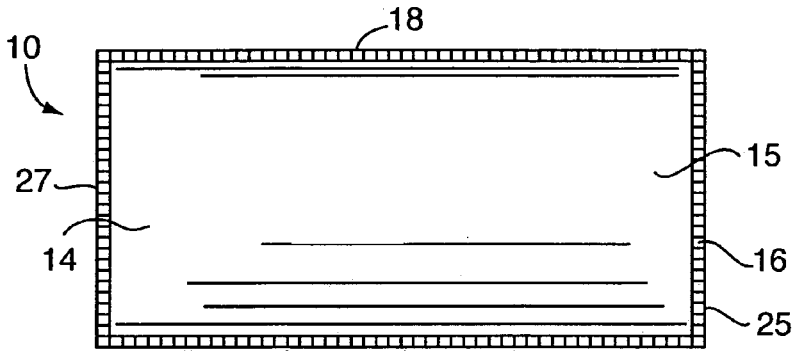
Figure 2:
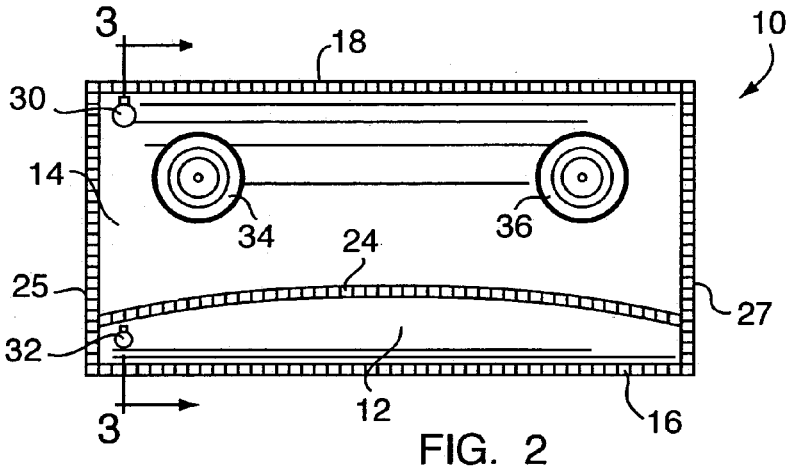

An inflatable pillow embodying the invention is shown designated generally at 10. The inflatable pillow 10 is constructed according to the teaching of my U.S. Pat. No. 6,684,429, issued Feb. 3, 2004, which is incorporated herein by reference. Referring to the plan views of FIGS. 1 and 2 and to the cross sections of FIGS. 3 and 4, the inflatable pillow 10 comprises a base sheet 12 of plastic on which a similar sized pocket sheet 14 of plastic is superposed. An air confining sheet section 15 of pocket sheet 14 is heat sealed as shown at 16 to the base sheet 12 around the margins to form an air tight inflatable air compartment 17. A water-containing sheet section 22 is sealed to the base sheet 12, along its peripheral edges 24 to define a water compartment 28.

The air confining sheet section 15 and the water-containing sheet section 22 are preferably part of a single pocket sheet 14, as shown, but could also be separate sheet sections and separately attached to base sheet 12 in the same manner. Both the base sheet 12 and the pocket sheet 14 are folded up around a lateral fold line 18 of the sheets. The side edges 25, 27 are connected together to form a pocket 26 between the folded sheet members. The connections on the side edges 25, 27 may be permanent or temporary. Preferably the side edges are sealed at 25, 27, but temporary fasteners such as snap fasteners or Velcro could also be used as more fully described in my U.S. Pat. No. 6,684,429.

A removable plug 30 provides a means to fill or drain the water compartment 28. An air fill port 32 is provided to inflate the air compartment 17 to a desired comfortable inflation level, and is closed by a removable plug.

In accordance with the present invention, suction cups 34, 36 are attached to the water-containing sheet section 22 of the pocket sheet 14 on the water compartment side below and substantially equidistant from fold line 18. The suction cups are attached by any in a suitable means, such as, gluing, heat sealing, or by mechanical connection. Any suitable number of suction cups may be employed, but I have found that two are sufficient in most cases.

Suction cups 34, 36 are designed to adhere to a smooth surface such as the back of a tub, Jacuzzi, or the like so as to support the inflatable pillow. They are preferably attached to sheet section 22 on the water compartment side, but could also be attached to sheet section 15 on the air compartment side. In this case the pillow is reversed from the position shown in FIG. 4 so that the water compartment faces outwardly. reference number 11 is constructed exactly as before, but has two suction cups 35, 37 attached to sheet section 15, which are used to attach the pillow to a smooth surface. All other reference numbers are the same as previously described.

OPERATION OF THE INVENTION

Figure 3:
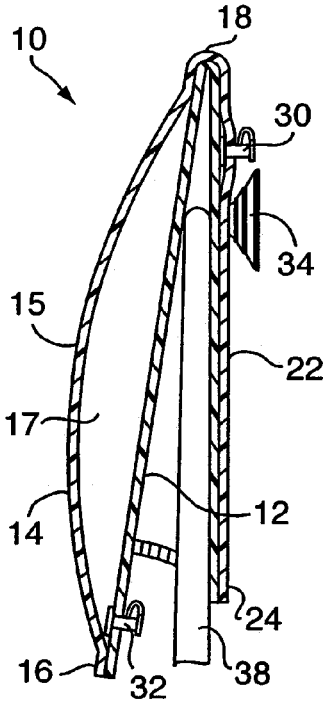

The operation of the invention will be made clearer by reference to the cross sectional views of FIGS. 3 and 4. In FIG. 3, a portion of the back of a beach chair or reclining lounge chair is shown and designated by reference number 38. The inflatable pillow 10 is dimensioned so that pocket 26 will accommodate the back of a beach chair or lounging chair of the type found around swimming pools or on beaches. The air compartment is inflated by blowing through air port 32 in the conventional way until the compartment 17 provides a comfortable pillow and then closed off.

Figure 4:
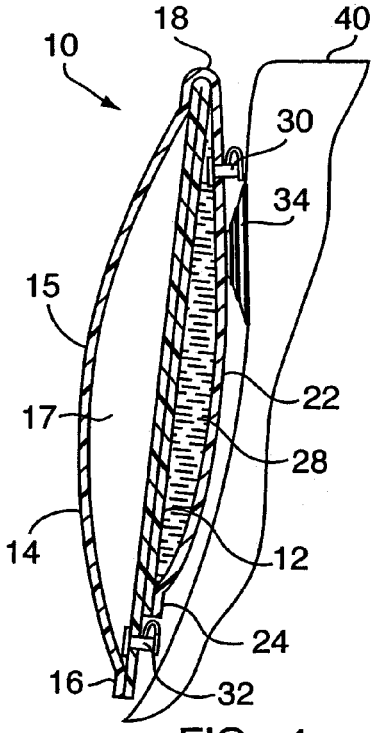

Reference to FIG. 4 of the drawing illustrates the expanded use of the inflatable pillow provided by the present invention. A portion of the back of a tub is indicated by reference numeral 40. Suction cup 36 is attached to the surface of a tub 40 in the conventional way, wetting it if necessary to obtain a better grip. In lieu of a tub, the suction cups may be attached to the deck or bow of a boat.

In accordance with the improvement of the present invention, the resilience and comfort of the inflatable pillow may be enhanced by partially filling the water compartment 28. The partially filled water compartment supports and improves the comfort of the outwardly facing air compartment of the inflatable pillow 10. If desired the water compartment may be filled or partially filled with hot water from the tub to provide additional warmth in cold weather, or it may be filled or partially filled with cold water to provide cooling in hot weather.

Figure 5:
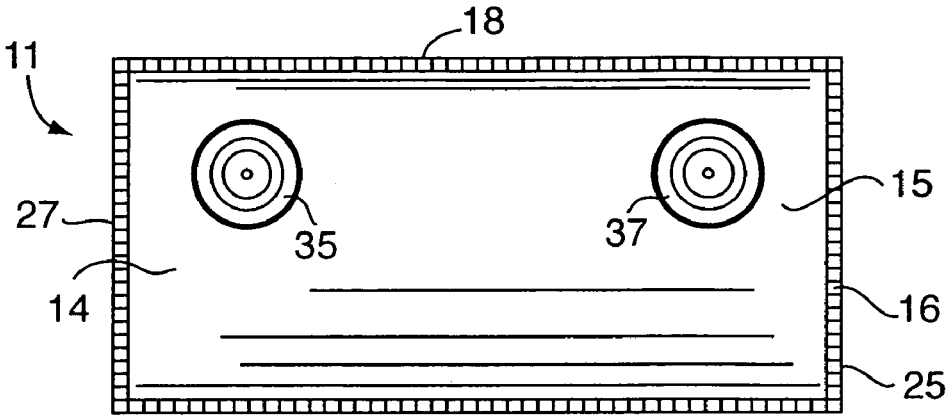
FIG. 5 is a top plan view of a modification of the inflatable pillow, looking at the air compartment side.
Figure 6:
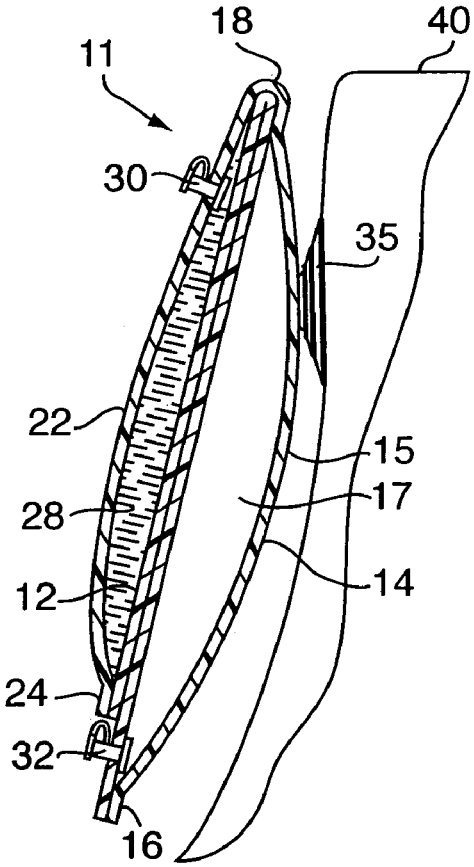
FIG. 6 is a side elevation view of the modification of FIG. 5, also in cross section, showing the inflatable pillow attached to the wall of a tub.

If the suction cups are optionally attached on the air compartment side to the air confining sheet section 15, then the air compartment supports the outwardly facing water compartment, as shown in FIGS. 5 and 6.

While there has been described what is considered to be the preferred embodiment of the invention, other modifications will occur to those skilled in the art, and it is desired to secure in the appended claims all such modifications as fall within the true spirit and scope of the invention.

What is claimed is:

1. Improvement to an inflatable pillow of the type having a generally rectangular flexible base sheet arranged to be folded about a fold line extending between its side edges, a first flexible sheet section sealed about its periphery to the base sheet on one side of the fold line to provide an inflatable air compartment, a second flexible sheet section sealed about its periphery to the base sheet on the other side of the fold line to provide a water compartment, an air valve communicating with the air compartment for inflating and deflating it, a closure valve communicating with the water compartment for filling and draining it and connection means to connect the folded base sheet along the side edges to form a pocket that may be slipped over the back of a chair and used to retain the inflatable pillow on the chair back, said improvement comprising: at least one suction cup attached to at least one of said first or said second flexible sheet sections so that the inflatable pillow may optionally be attached to a smooth surface, whereby said pillow may serve as a combination chair pillow and a tub pillow for a bath or spa.

2. The improvement according to claim 1, whereby said at least one suction cup is attached to said first flexible sheet section so that said inflatable air compartment side of the pillow may optionally be attached to said smooth surface with the water compartment facing outwardly.

3. The improvement according to claim 1, whereby said at least one suction cup is attached to said second flexible sheet section so that said water compartment side of the pillow may optionally be attached to said smooth surface with the inflatable air compartment facing outwardly.

4. The improvement according to claim 1, whereby said at least one suction cup comprises first and second suction cups which are spaced from each other and which are attached to said first flexible sheet section on either side of the pillow below and substantially equidistant from said fold line so that said inflatable air compartment side of the pillow may optionally be attached to said smooth surface with the water compartment facing outwardly.

5. The improvement according to claim 1, whereby said at least one suction cup comprises first and second suction cups which are spaced from each other and which are attached to said second flexible sheet section on either side of the pillow below and substantially equidistant from said fold line so that said water compartment side of the pillow may optionally be attached to said smooth surface with the inflatable air compartment facing outwardly.

* * * * *